US011796228B2

(12) United States Patent
Wada et al.

(10) Patent No.: US 11,796,228 B2
(45) Date of Patent: Oct. 24, 2023

(54) HEAT EXCHANGER, REFRIGERATING MACHINE AND SINTERED BODY

(71) Applicant: NATIONAL UNIVERSITY CORPORATION TOKAI NATIONAL HIGHER EDUCATION AND RESEARCH SYSTEM, Nagoya (JP)

(72) Inventors: Nobuo Wada, Nagoya (JP); Taku Matsushita, Nagoya (JP); Mitsunori Hieda, Nagoya (JP)

(73) Assignee: NATIONAL UNIVERSITY CORPORATION TOKAI NATIONAL HIGHER EDUCATION AND RESEARCH SYSTEM, Nagoya (JP)

( * ) Notice: Subject to any disclaimer, the term of this patent is extended or adjusted under 35 U.S.C. 154(b) by 256 days.

(21) Appl. No.: 16/975,511

(22) PCT Filed: Feb. 25, 2019

(86) PCT No.: PCT/JP2019/006960
§ 371 (c)(1),
(2) Date: Aug. 25, 2020

(87) PCT Pub. No.: WO2019/163978
PCT Pub. Date: Aug. 29, 2019

(65) Prior Publication Data

US 2021/0033312 A1 Feb. 4, 2021

(30) Foreign Application Priority Data

Feb. 26, 2018 (JP) ..... 2018-032417

(51) Int. Cl.
*F25B 9/12* (2006.01)
*F28F 13/00* (2006.01)
(Continued)

(52) U.S. Cl.
CPC ..... *F25B 9/12* (2013.01); *F28F 3/06* (2013.01); *F28F 13/003* (2013.01); *F28F 21/08* (2013.01);
(Continued)

(58) Field of Classification Search
CPC ..... F25B 9/12; F28F 13/185; F28F 13/003; F28F 2255/18; F28F 2255/20
See application file for complete search history.

(56) References Cited

U.S. PATENT DOCUMENTS 3,626,706 A * 12/1971 Elsner ..... F17C 3/085 62/51.1
4,127,424 A * 11/1978 Ullery, Jr. ..... H01L 31/046 257/E27.125
(Continued)

FOREIGN PATENT DOCUMENTS

CN 105762291 A * 7/2016 ..... H01B 13/0013
JP S58-124196 A 7/1983
(Continued)

OTHER PUBLICATIONS

Translation of Chinese Patent Document CN105762291A entitled Translation—CN105762291A (Year: 2016).*
(Continued)

*Primary Examiner* — Paul Alvare
(74) *Attorney, Agent, or Firm* — Locke Lord LLP

(57) ABSTRACT

A heat exchanger includes: a low temperature side channel through which low temperature liquid helium flows; a high temperature side channel through which high temperature liquid helium flows; and a thermal conduction unit that conducts heat from the high temperature side channel to the low temperature side channel. The thermal conduction unit has a partition member that separates the high temperature side channel and the low temperature side channel from each
(Continued)

other and a thermal resistance reduction unit that reduces the thermal resistance between the partition member and the liquid helium. The thermal resistance reduction unit has a porous body having nano-size pores and fine metal particles having higher thermal conductivity than that of the porous body.

10 Claims, 5 Drawing Sheets

(51) Int. Cl.
*F28F 21/08* (2006.01)
*F28F 3/06* (2006.01)

(52) U.S. Cl.
CPC ..... *F28F 2255/18* (2013.01); *F28F 2255/20* (2013.01)

(56) References Cited

U.S. PATENT DOCUMENTS 4,478,276 A * 10/1984 Rosenbaum ..... F28F 13/18 165/905
7,045,205 B1 * 5/2006 Sager ..... H01L 51/4213 257/466
7,491,852 B1 * 2/2009 Chou ..... C07C 45/39 568/474
9,375,710 B2 * 6/2016 Hancu ..... B01J 23/74
2004/0219348 A1 * 11/2004 Jacquiod ..... C03C 17/007 427/372.2
2004/0231758 A1 * 11/2004 Hampden-Smith ..... C09K 11/595 427/229
2006/0102519 A1 * 5/2006 Tonkovich ..... B01F 33/30 208/107
2008/0295695 A1 * 12/2008 Takeuchi ..... A01G 25/02 96/108
2010/0221542 A1 * 9/2010 Auger ..... C01B 33/146 428/402
2012/0225003 A1 * 9/2012 Joung ..... C01B 33/166 423/338
2013/0258595 A1 * 10/2013 Tuckerman ..... H05K 7/20372 165/104.11
2016/0223229 A1 * 8/2016 Takeuchi ..... F25B 35/04
2016/0313034 A1 * 10/2016 Takeuchi ..... F28F 13/003
2018/0094204 A1 * 4/2018 Larimer ..... C10M 107/50
2018/0112928 A1 * 4/2018 Dorr ..... H01L 23/3677
2018/0230590 A1 * 8/2018 Farquhar ..... C22C 1/08
2019/0044042 A1 * 2/2019 Nakada ..... H01L 35/30
2021/0033312 A1 * 2/2021 Wada ..... F25B 9/12

FOREIGN PATENT DOCUMENTS

JP H01-266495 A 10/1989
JP H07-260266 A 10/1995
JP H08-283009 A 10/1996
JP 2001-118891 A 4/2001
JP 2002-71297 A 3/2002
JP 2006-220326 A 8/2006
JP 2009-74774 A 4/2009
JP 2009-198416 A 9/2009
JP 2012-214315 A 11/2012
WO 2005/040067 A1 5/2005
WO 2014/129626 A1 8/2014

OTHER PUBLICATIONS

Notification of Reason(s) for Refusal dated Nov. 30, 2021, issued for Japanese Patent Application No. 2020-501078 and English translation thereof.
Decision of Rejection dated Feb. 11, 2022, issued for Chinese Patent Application No. 201980015009.0 and English translation thereof.
Office Action dated Sep. 24, 2021, issued for corresponding Chinese Patent Application No. 201980015009.0 and English translation thereof.
International Search Report dated May 14, 2019, issued for PCT/JP2019/006960.
International Preliminary Report on Patentability dated Aug. 27, 2020, issued for PCT/JP2019/006960.
Office Action dated May 31, 2021, issued for Chinese Patent Application No. 201980015009.0 and English translation thereof.
Office Action dated May 18, 2021, issued for corresponding Japanese patent application No. 2020-501078 and English translation thereof.

* cited by examiner

18

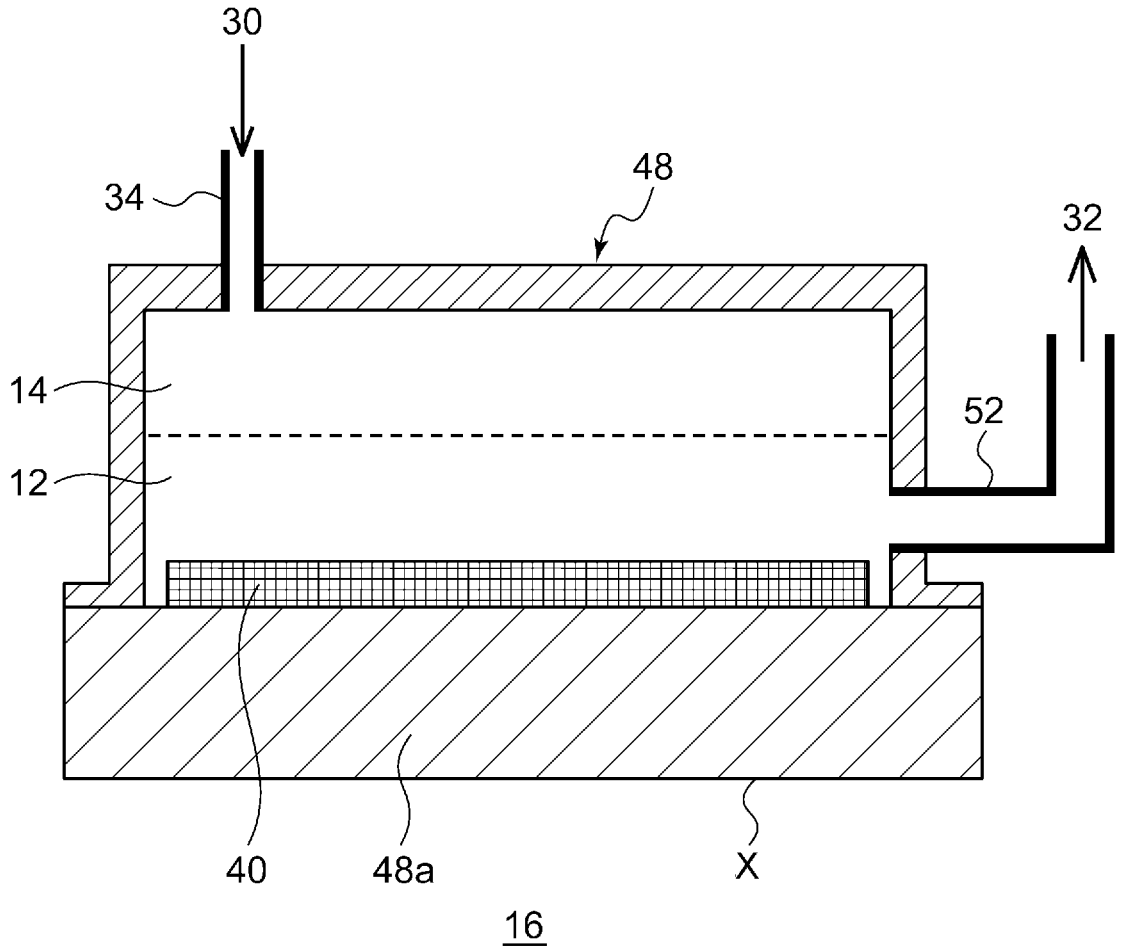
30
34
48
32
14
52
12
40
48a
X
16

HEAT EXCHANGER, REFRIGERATING MACHINE AND SINTERED BODY

CROSS-REFERENCE TO RELATED APPLICATIONS

This application is based upon and claims the benefit of priority from the prior Japanese Patent Application No. 2018-032417, filed on Feb. 26, 2018 and International Patent Application No. PCT/JP2019/006960, filed on Feb. 25, 2019, the entire content of each of which is incorporated herein by reference.

BACKGROUND OF THE INVENTION

1. Field of the Invention

The present disclosure relates to a heat exchanger used for a refrigerator.

2. Description of the Related Art

Conventionally, $^3$He/$^4$He dilution refrigerators are known as refrigerators that realize an extremely low temperature of 100 mK or less. The minimum attainable temperature and the cooling capacity of such a dilution refrigerator greatly depend on the performance of the heat exchanger. The heat exchanger of a dilution refrigerator cools a so-called $^3$He dense phase (C phase: $^3$He concentration of almost 100%) flowing into the mixing chamber, which is a cooling unit, with a so-called $^3$He dilute phase (D phase: $^3$He concentration of about 6.4%).

Therefore, how efficiently the heat of the $^3$He dense phase is conducted to the $^3$He diluted phase is important. For example, in order to improve the thermal conduction, a heat exchanger has been devised in which a metal plate that separates a dense phase and a dilute phase from each other is composed of a silver plate having high thermal conductivity and discs made of sintered silver are arranged so as to sandwich the silver plate (see Patent Document 1).

[Patent Document 1] Japanese Patent Application Publication No. 2009-74774

Since $^3$He used in the above-mentioned dilution refrigerator is extremely rare and expensive, suppressing the amount of $^3$He used contributes to cost reduction and downsizing of the device. Further, since the performance of the dilution refrigerator largely depends on the performance of the heat exchanger, it is required to further improve the thermal conduction in the heat exchanger of the refrigerator.

SUMMARY OF THE INVENTION

In this background, an exemplary purpose of the present disclosure is to provide a new technology for further improving thermal conduction in a heat exchanger of a refrigerator.

A heat exchanger according to one embodiment of the present disclosure includes: a low temperature side channel through which low temperature liquid helium flows; a high temperature side channel through which high temperature liquid helium flows; and a thermal conduction unit that conducts heat from the high temperature side channel to the low temperature side channel. The thermal conduction unit has a metal member that separates the high temperature side channel and the low temperature side channel from each other and a thermal resistance reduction unit that reduces the thermal resistance between the metal member and liquid helium. The thermal resistance reduction unit has a porous body having nano-size pores and fine metal particles having higher thermal conductivity than that of the porous body.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5 is a schematic diagram showing a schematic configuration of a mixing chamber according to the present embodiment.

DETAILED DESCRIPTION OF THE INVENTION

Figure 1:
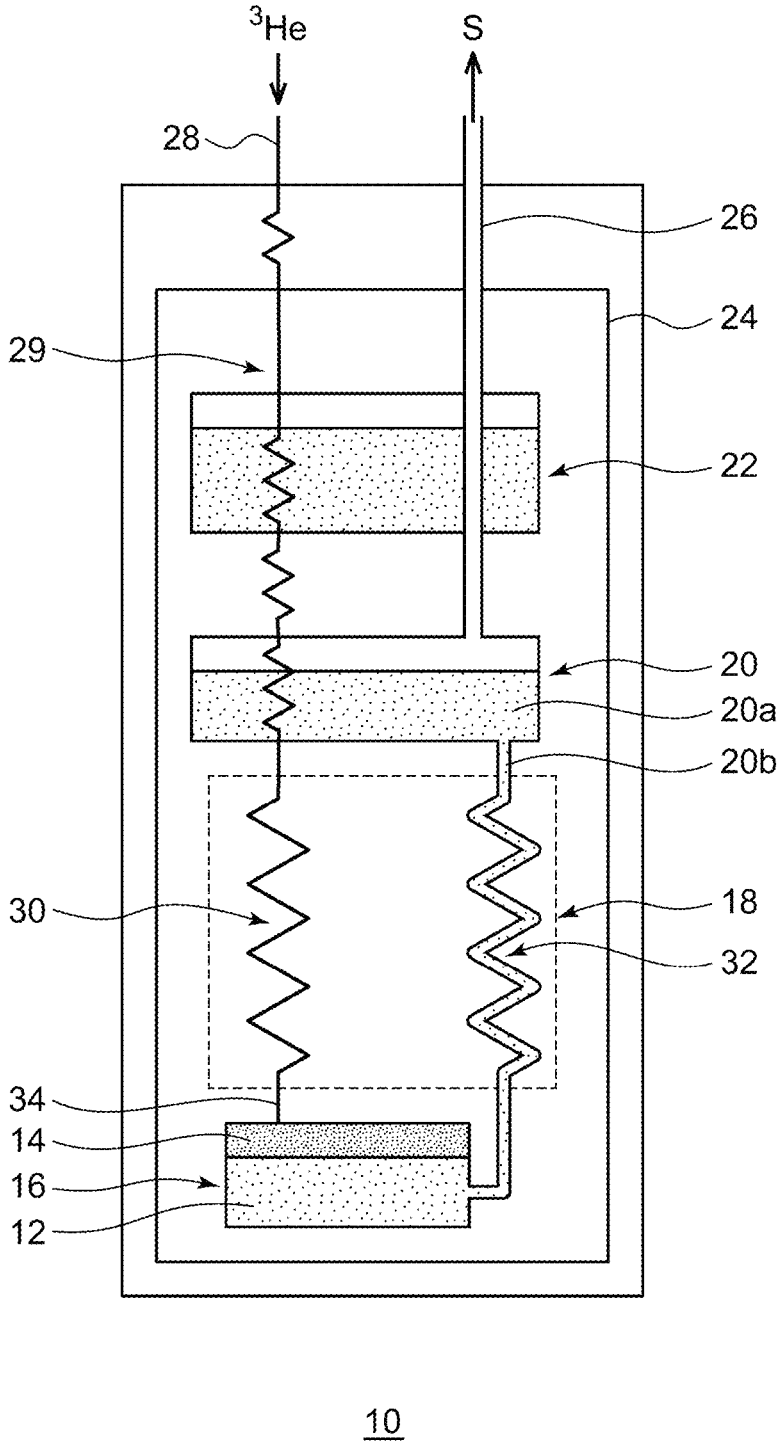
FIG. 1 is a schematic diagram showing a schematic configuration of a dilution refrigerator according to the present embodiment.

A heat exchanger according to an aspect of the present disclosure includes a low temperature side channel through which low temperature (for example, low $^3$He concentration) liquid helium flows, a high temperature side channel through which high temperature (for example, high $^3$He concentration) liquid helium flows, and a thermal conduction unit that conducts heat from the high temperature side channel to the low temperature side channel. The thermal conduction unit has a metal member that separates the high temperature side channel and the low temperature side channel from each other and a thermal resistance reduction unit that reduces the thermal resistance between the metal member and liquid helium. The thermal resistance reduction unit has a porous body having nano-size pores and fine metal particles having higher thermal conductivity than that of the porous body.

According to this aspect, by forming the thermal resistance reduction unit with the fine metal particles having relatively high thermal conductivity and the porous body having a large specific area, the thermal resistance between the metal member and the liquid helium can be reduced compared with a case where only the fine metal particles are fixed on the surface of the metal member. Therefore, thermal conduction from the high temperature side channel to the low temperature side channel can be further improved.

The thermal resistance reduction unit may be a sintered compact of the porous body and the fine metal particles. This allows the thermal resistance between the metal member and liquid helium to be reduced by reducing the Kapitza resistance by increasing the contact area with liquid helium using the porous body and performing the thermal conduction between the porous body and the metal member through the fine metal particles having higher thermal conductivity than the porous body.

The thickness of the thermal resistance reduction unit may be in a range of 1 to 1000 μm, more preferably in a range of 1 to 500 μm, and most preferably in a range of 1 to 200 μm. This makes it possible to reduce the thermal resistance of the entire thermal resistance reduction unit while including a porous body having nano-size pores to some extent.

The porous body may be a particle having through holes formed on the surface as pores. Thereby, helium in the pores can be directly connected to the outside of the porous body particle allowing for thermal conduction.

The through holes on the surface of the porous body particle may have a diameter that allows helium to exist as a liquid inside the through holes. Thereby, conduction of heat between the same helium liquids is possible in the through holes. The through holes are holes continuing from the openings formed on the surface of the porous body to the inside of the porous body, and the inlet or the outlet may be closed with fine metal particles or the like.

The pores of the porous body preferably have a diameter that allows helium (for example, $^3$He) to exist as a liquid in the central part of the pores and the helium (for example, $^3$He) liquids to exist while being connected to one another, even when a solid state helium (for example, $^4$He) layer is formed on the inner wall of the pores of the porous body. More specifically, the porous body may have an average pore diameter in a range of 2 to 30 nm.

The porous body may be a silicate particle having an average particle size in a range of 50 to 20000 nm. This makes it possible to achieve both a large specific area that contributes to a reduction in the Kapitza resistance and a reduction in a thermal conduction distance via a porous silicate member that affects the thermal resistance.

The specific area of the porous body may be 600 $m^2/g$ or more. This allows the Kapitza resistance at the interface between the porous body and liquid helium to be reduced.

The fine metal particles may be fine silver particles having an average particle size in a range of 50 to 100000 nm. Thereby, the fine metal particles are fixed to the metal member as a sintered compact such that the fine metal particles surround the porous body.

Another aspect of the present disclosure relates to a refrigerator. This refrigerator may include: the above-mentioned heat exchanger; a mixing chamber inside which a $^3$He dilute phase and a $^3$He dense phase are formed and that has an inflow passage for a $^3$He liquid to flow into the $^3$He dense phase from the high temperature side channel and an outflow passage for a $^3$He liquid to flow out to the low temperature side channel from the $^3$He dilute phase; a still that has an inflow passage for a $^3$He liquid flowing in the low temperature side channel to flow in and selectively separates $^3$He as vapor from a liquid mixture of a $^4$He liquid and a $^3$He liquid; and a cooling path that liquefies $^3$He separated in the still and returns the liquefied $^3$He to the high temperature side channel.

Yet another aspect of the present disclosure relates to a sintered compact. This sintered compact is a sintered compact of a porous body having nano-size pores and fine metal particles having higher thermal conductivity than that of the porous body. $^4$He and $^3$He are adsorbed inside the pores of the porous body. Thereby, the thermal resistance of the sintered compact can be made sufficiently small.

According to this aspect, the thermal conduction in the heat exchanger is further improved, and it is therefore possible to improve the refrigeration performance and downsize the entire refrigerator.

Optional combinations of the aforementioned constituting elements, and implementations of the present disclosure in the form of methods, apparatuses, systems, etc., may also be practiced as additional modes of the present disclosure.

Hereinafter, an embodiment for carrying out the present disclosure will be described in detail with reference to the accompanying drawing and the like. In the explanations of the figures, the same elements shall be denoted by the same reference numerals, and duplicative explanations will be omitted appropriately. The structure described below is by way of example only and does not limit the scope of the present disclosure.

Dilution Refrigerator

A dilution refrigerator according to the present embodiment is a typical refrigerator that realizes an extremely low temperature of 100 mK or less. FIG. 1 is a schematic diagram showing a schematic configuration of a dilution refrigerator according to the present embodiment. A dilution refrigerator 10 includes: a mixing chamber 16 inside which a $^3$He dilute phase (hereinafter, appropriately referred to as "dilute phase") 12 and a $^3$He dense phase (hereinafter, appropriately referred to as "dense phase") 14 are formed; a heat exchanger 18 that exchanges heat between a $^3$He liquid flowing into the mixing chamber 16 and a liquid mixture of a $^3$He liquid and a $^4$He liquid flowing out from the mixing chamber 16; a still 20 that selectively separates $^3$He as vapor from a liquid mixture of a $^3$He liquid and a $^4$He liquid; and a 1K storage chamber 22 that stores 1K liquid helium. The still 20 has an inflow passage 20*b* into which a liquid mixture flowing through the low temperature side channel 32 flows. The mixing chamber 16, the heat exchanger 18, the still 20, and the 1K storage chamber 22 are arranged in a cryostat 24 that is vacuum-insulated.

Next, the operation of the dilution refrigerator 10 will be described. A liquid mixture of $^3$He and $^4$He causes phase separation at a low temperature of 0.87K or less. Therefore, in the mixing chamber 16, a liquid mixture of $^3$He and $^4$He is separated into a dense phase 14 in which $^3$He is close to 100% and a dilute phase 12 in which $^3$He is mixed in about 6.4% in $^4$He, and the phases coexist.

Since the dense phase 14 has a lower density than the dilute phase 12, the dense phase 14 floats over the dilute phase 12, and when $^3$He of the dense phase 14 dissolves (is diluted) in the dilute phase 12, cooling according to the entropy difference occurs. The dilution refrigerator 10 is a refrigerator that utilizes an entropy difference between two phases, a dense phase and a dilute phase.

When the temperature of the still 20 is set to 0.8K or less, only $^3$He is selectively evaporated due to the difference in vapor pressure. Then, by sucking with a vacuum pump outside the cryostat 24, which is connected to a discharge passage 26 of the still 20, $^3$He can be selectively separated and removed as vapor S from a dilute phase 20*a*.

As a result, the $^3$He concentration in the dilute phase 20*a* in the still 20 decreases, and a concentration difference occurs between the dilute phase 20*a* and the dilute phase 12 in the mixing chamber 16. As a result, $^3$He in the dilute phase 12 in the mixing chamber 16 moves toward the still 20, and the $^3$He concentration in the dilute phase 12 decreases. Therefore, $^3$He in the dense phase 14 dissolves in the dilute phase 12. At this time, cooling occurs, and the temperature of the dilute phase 12 in the mixing chamber 16 further decreases.

$^3$He vapor S evaporated in the still 20 is recovered and compressed by an external pump and is returned to the mixing chamber 16 through a supply passage 28. The $^3$He vapor S supplied through the supply passage 28 is pre-cooled with $^4$He of 4.2K and further cooled in the 1K storage chamber 22 to be liquefied. In the present embodiment, the path from the supply passage 28 to the high temperature side channel 30 via the 1K storage chamber 22 functions as a cooling path 29 that liquefies $^3$He and returns the liquefied $^3$He to the high temperature side channel 30. In the process of passing through the high temperature side channel 30 of the heat exchanger 18, the liquefied $^3$He is further cooled by exchanging heat with $^3$He passing through the low temperature side channel 32 of the heat exchanger 18, and returns to the dense phase 14 from the inflow passage 34 of the mixing chamber 16.

As described above, the dilution refrigerator 10 according to the present embodiment continuously achieves an extremely low temperature from 1 K to several mK by the circulation of $^3$He, and is therefore expected to be used in various fields such as semiconductor detectors, quantum computers, etc., that require cooling with an extremely low temperature. Further, it is also important in the popularization of dilution refrigerators to reduce the amount of expensive $^3$He used and downsize the devices without deteriorating the cooling performance.

Heat Exchanger

The inventors of the present invention focused on a heat exchanger, which is one of the features that greatly affects the performance of such a dilution refrigerator, and devised a new technology for improving particularly thermal conduction from the high temperature side channel 30 to the low temperature side channel 32.

Figure 2:
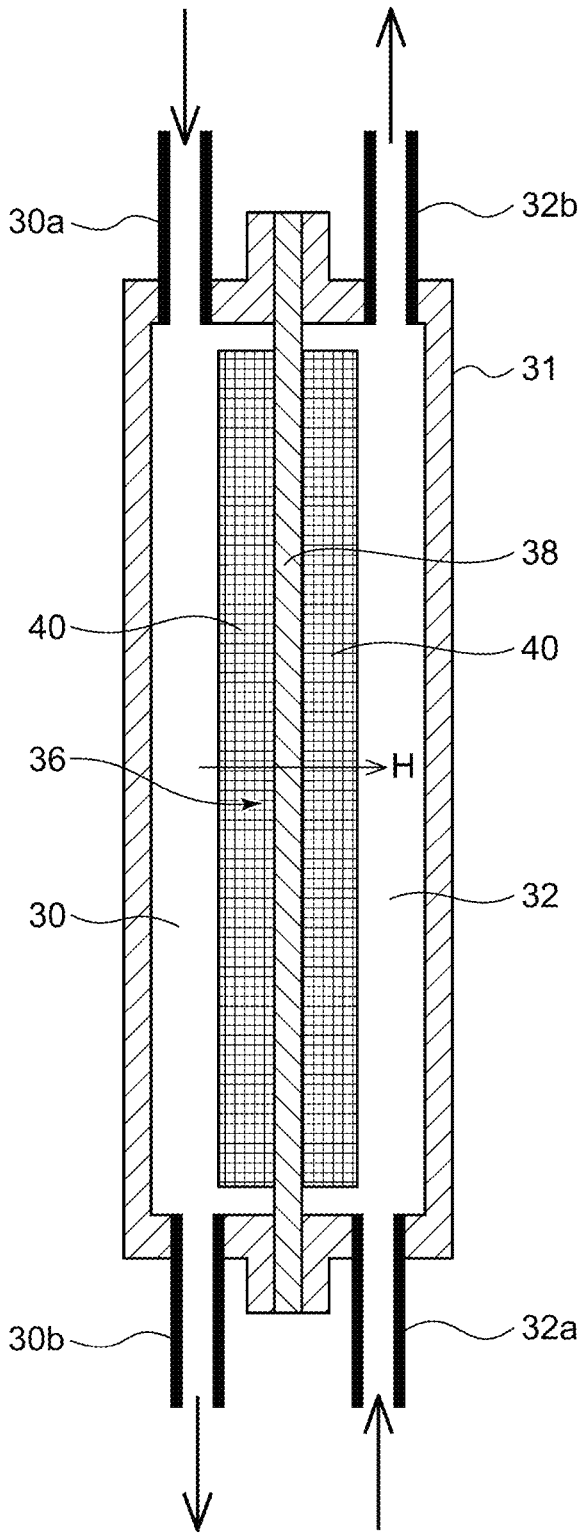
FIG. 2 is a schematic diagram showing a schematic configuration of a heat exchanger according to the present embodiment.

FIG. 2 is a schematic diagram showing a schematic configuration of a heat exchanger according to the present embodiment. A heat exchanger 18 according to the present embodiment includes, inside a container 31, a low temperature side channel 32 through which liquid helium having a low $^3$He concentration (about 6.4%) flows, a high temperature side channel 30 through which liquid helium having a high $^3$He concentration (about 100%) flows, and a thermal conduction unit 36 that conducts heat H from the high temperature side channel 30 to the low temperature side channel 32.

The high temperature side channel 30 has an inflow passage 30*a* into which $^3$He pre-cooled in the 1K storage chamber 22 and the still 20 flows, and an outflow passage 30*b* from which $^3$He further cooled in the heat exchanger 18 flows out. The low temperature side channel 32 has an inflow passage 32*a* into which $^3$He mainly flows from the dilute phase 12 of the mixing chamber 16, and an outflow passage 32*b* for causing $^3$He removing heat H from $^3$He flowing in the high temperature side channel 30 to flow out toward the dilute phase 20*a* of the still 20. The thermal conduction unit 36 has a plate-like metal member 38 as a partition member that separates the high temperature side channel 30 and the low temperature side channel 32 from each other, and a thermal resistance reduction unit 40 that reduces the thermal resistance between the metal member 38 and liquid helium. The metal member 38 is made of, for example, a material having high thermal conductivity such as copper and silver. The partition member may be made of a material having high thermal conductivity such as diamond besides metal.

In heat exchange in a temperature range of about 100 mK or less where the dilution refrigerator 10 is used, the Kapitza resistance generated at the interface between a solid surface such as the metal member 38 and liquid helium is one of the main factors that deteriorate the heat exchange performance. Thus, one possibility is to fix fine metal particles of silver or copper, which is a material that can maximize the interface area and that has good thermal conductivity, to the surface of the metal member 38. However, by combining a plurality of functional members, the inventors of the present invention have conceived of a thermal resistance reduction unit 40 that can achieve thermal conduction performance that cannot be realized by fine metal particles alone.

Thermal Resistance Reduction Unit

Figure 3:
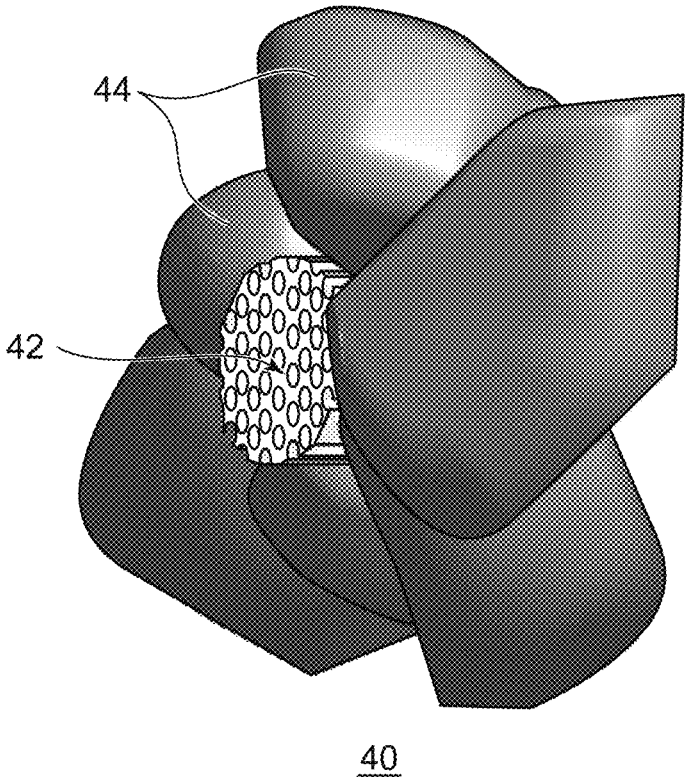
FIG. 3 is a schematic diagram showing a main part of a thermal resistance reduction unit according to the present embodiment.

FIG. 3 is a schematic diagram showing a main part of a thermal resistance reduction unit 40 according to the present embodiment. Although FIG. 3 illustrates a structure centering on one nanoporous body, it is obvious that the thermal resistance reduction unit 40 includes a large number of nanoporous bodies and fine metal particles.

As shown in FIG. 3, the thermal resistance reduction unit 40 according to the present embodiment has a porous body 42 having nano-size pores and fine silver metal particles 44 having higher thermal conductivity than that of the porous body 42. As described above, by forming the thermal resistance reduction unit 40 with the fine metal particles 44 having relatively high thermal conductivity and the porous body 42 having a large specific area, the thermal resistance between the metal member 38 and the liquid helium can be reduced compared with a case where only the fine metal particles 44 are fixed on the surface of the metal member 38. Therefore, thermal conduction from the high temperature side channel 30 to the low temperature side channel 32 can be further improved.

Further, the thermal resistance reduction unit 40 is a sintered compact of the porous body 42 and the fine metal particles 44 fixed to the metal member 38. This allows the thermal resistance between the metal member 38 and liquid helium L to be reduced by reducing the Kapitza resistance by increasing the contact area with liquid helium using the porous body 42 and performing the thermal conduction between the porous body 42 and the metal member 38 through the fine metal particles 44 having higher thermal conductivity than the porous body 42.

Porous Body

Figure 4:
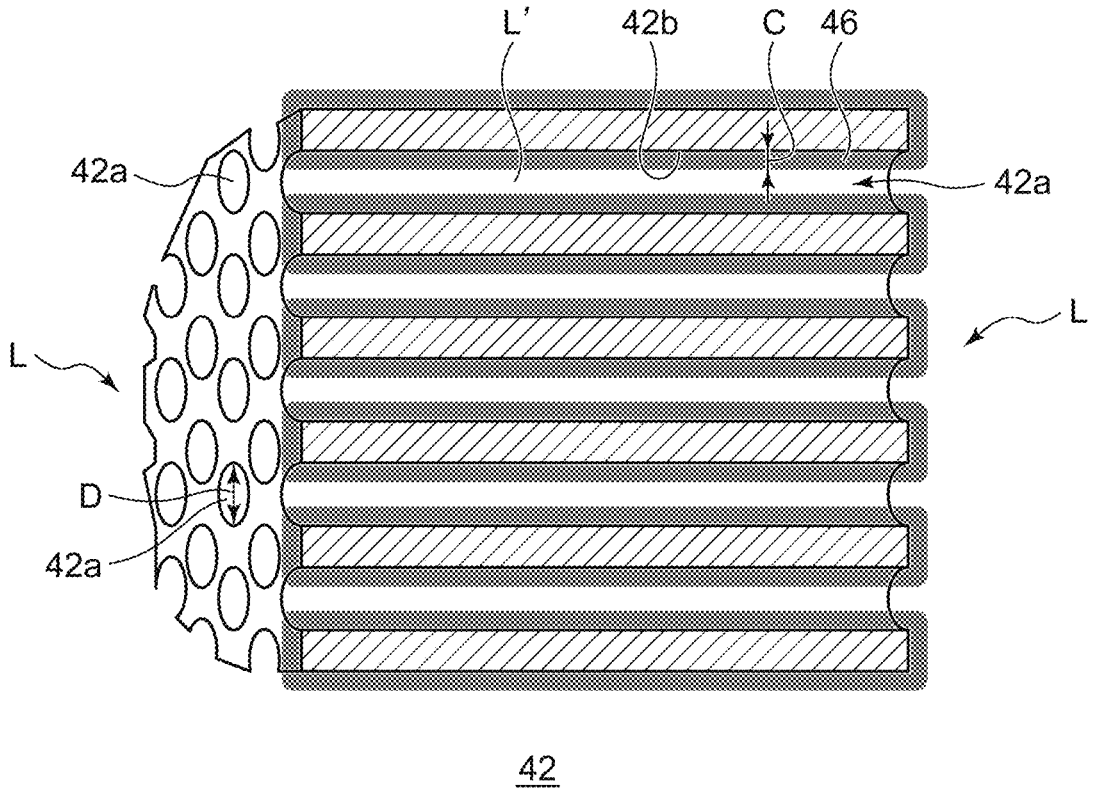
FIG. 4 is a schematic diagram schematically showing a schematic configuration of a porous body according to the present embodiment.

FIG. 4 is a schematic diagram schematically showing a schematic configuration of the porous body 42 according to the present embodiment. The porous body 42 is a nanoporous body (mesoporous silica) made of silicate or the like and has a plurality of nano-size pores 42*a* formed regularly. Therefore, the specific area of the porous body 42 is 600 to 1300 $m^2/g$, which is larger by three digits or more than the specific area (approximately 1 $m^2/g$) of fine metal particles such as silver. Since the thermal resistance due to the Kapitza effect decreases inversely in proportion to the interface area, thermal conduction between the metal member 38 and liquid helium via the porous body 42 allows the Kapitza resistance at the interface between the metal member 38 and liquid helium to be reduced. Further, since even a small thermal conduction unit 36 allows a sufficient interface area to be secured, the device can be downsized.

Further, the average pore diameter D of the pores 42*a* is preferably small from the viewpoint of the specific area. However, according to the study by the present inventors, it is found that, in the pores 42*a* of the porous body 42 that is in contact with the liquid helium L and has a pore size of more than about 2 nm, helium (mainly $^4$He) in a solid state is adsorbed on a pore wall surface 42*b*. The thickness C of a solid layer 46 made of helium in a solid state at that time is about 0.6 nm. Since the average interparticle distance of liquid helium is about 0.4 nm, when the pore diameter is 1.5 nm or less, the entire pores are filled with helium in a solid state.

The pore diameter D of the porous body 42 according to the present embodiment is about 3.9 nm measured by the Barrett-Joyner-Halenda (BJH) method. Therefore, a cylindrical region having a diameter of 2.7 nm inside the solid layer 46 is filled with a $^3$He liquid L' contained in the dilute phase 12 or the dense phase 14. Since the diameter of a columnar region of the $^3$He liquid L' is sufficiently larger than the interparticle distance of liquid helium of about 0.4 nm, the same properties, such as thermal conduction, as the helium liquid L located around the porous body 42 are expected. The liquid helium L around the porous body 42 and the $^3$He liquid L' in the pores 42*a* are directly connected to each other via through holes on the surface of the porous body particle.

The thermal resistance derived from the Kapitza thermal resistance between the $^3$He liquid L' in the pores 42*a* and a porous body pore wall surface is inversely proportional to the total area of the pore wall surface. Due to the enormous specific area of the porous body 42, even in a case of a small heat exchanger, a large area is realized, and the thermal resistance derived from the Kapitza thermal resistance is reduced. In this way, thermal conduction between the liquid helium L around the porous body 42 and the silicate member of the porous body 42 is improved.

Thus, in the porous body 42, the pores 42*a* have a diameter that allows $^3$He to exist in a liquid state inside the pores, and the pores 42*a* are through holes. As a result of this, thermal conduction at both ends of the pores 42*a* can be efficiently performed via the $^3$He liquid L'. Further, direct connection between the outside of the particulate porous body 42 and the $^3$He liquid L' in the pores 42*a* allows thermal conduction.

The average pore diameter D of the porous body 42 is preferably set such that the diameter of the cylindrical $^3$He liquid L' in the central parts of the pores 42*a* is sufficiently larger than the interparticle distance of liquid helium of about 0.4 nm. In this case, considering the thickness of 0.6 nm of the solid layer 46 of $^4$He in a solid state, at least the pore diameter D needs to be 1.6 nm or more, preferably 2 nm or more, and more preferably 30 nm or less from the viewpoint of the specific area. This allows the $^3$He liquid L' having a diameter that is sufficiently larger than 0.4 nm to exist in the central parts of the pores 42*a*.

When the porous body 42 is made of silicate, if the average particle size is too large, the thermal resistance of the porous body 42 itself increases. Further, if the average particle size is too small, it becomes difficult to adjust the average pore size D to be in an appropriate range. Therefore, the porous bodies 42 according to the present embodiment are silicate particles whose average particle size is in a range of 50 to 20000 nm, preferably in a range of 100 to 500 nm, in consideration of the thermal resistance and the like of the member of the porous body 42. This makes it possible to achieve both a large specific area that contributes to a reduction in the Kapitza resistance and a reduction in a thermal conduction distance via a porous silicate member that affects the thermal resistance. Examples of the silicate particles suitable for the porous body 42 include, for example, FSM-16, MCM-41, and the like.

The fine metal particles 44 according to the present embodiment are fine silver particles whose average particle size is in a range of 50 to 100000 nm. As a result, the fine metal particles 44 having good thermal conductivity are fixed to the metal member 38 as a sintered compact such that the fine metal particles 44 surround the porous body 42.

The thermal resistance reduction unit 40 according to the present embodiment has a thickness in a range of 1 to 500 μm. This allows a certain amount of fine metal particles 44 to surround the porous body 42 having nano-size pores so that the thermal resistance between the metal member 38 and liquid helium via the fine metal particles 44 can be reduced. The thickness of the thermal resistance reduction unit 40 may be in a range of 1 to 1000 μm, and most preferably in a range of 1 to 200 μm.

As described above, in the dilution refrigerator 10 according to the present embodiment, the thermal conduction in the heat exchanger 18 is further improved, and it is therefore possible to improve the refrigeration performance and downsize the entire refrigerator.

Performance Evaluation

The sintered structure of the above nanoporous body and silver was evaluated by measuring the ultralow temperature specific heat of $^4$He and $^3$He adsorbed on the nanoporous body. The specific heat was measured by the quasi-adiabatic heat pulse method, and a heater and a thermometer were attached to a specific heat container. Then, the relaxation time until the temperature of the adsorbed helium and the temperature of the container reached the same temperature was measured by analyzing the time evolution of the container temperature after applying a heat pulse. As a result, it was confirmed that up to a temperature of 26 mK, the relaxation time was shorter than the response time of the thermometer of about 5 seconds, and the thermal resistance was sufficiently small.

Therefore, a step-type heat exchanger having the thermal resistance reduction unit 40 according to the present embodiment was manufactured and was then attached to a helium dilution refrigerator and operated. A dilution refrigerator operated without a step-type heat exchanger and only with a tube-in-tube heat exchanger reached a minimum temperature of about 35 mK when $^3$He was continuously circulated at about 20 μmol/sec, and the minimum temperature reached the 20 mK level in the case of single-shot (a method in which the circulation of $^3$He is stopped and only collection is performed for cooling). On the other hand, when the heat exchanger according to the present embodiment was attached to this dilution refrigerator, the minimum temperature reached 20.6 mK in the case of continuous circulation, and the minimum temperature reached 8.6 mK in the case of single-shot. As described above, in the dilution refrigerator according to the present embodiment, the minimum attainable temperature is improved, which shows the effectiveness of the thermal resistance reduction unit 40 including the porous body 42.

The above-mentioned thermal resistance reduction unit 40 can be used not only for the heat exchanger 18 but also for the thermal conduction unit of the mixing chamber 16. FIG. 5 is a schematic diagram showing a schematic configuration of the mixing chamber 16 according to the present embodiment. The mixing chamber 16 is provided with a container 48 in which an inflow passage 34 through which a $^3$He liquid flows from the high temperature side channel 30 into the dense phase 14 and an outflow passage 52 through which a $^3$He liquid flows out from the dilute phase 12 into the low temperature side channel 32 are formed.

The thermal resistance reduction unit 40 is arranged inside a bottom part 48*a* of the container 48. Thereby, the thermal resistance of the liquid helium of the dilute phase 12 and the bottom part 48*a* can be reduced, and the cooling performance when the bottom part 48*a* is used as a cooling surface X can be improved.

Described above is an explanation based on the embodiments of the present disclosure. These embodiments are intended to be illustrative only, and it will be obvious to those skilled in the art that various modifications to constituting elements and processes could be developed and that such modifications are also within the scope of the present disclosure.

The invention claimed is:

1. A heat exchanger comprising:

a low temperature side channel through which low temperature liquid helium flows;

a high temperature side channel through which high temperature liquid helium flows; and a thermal conduction unit that conducts heat from the high temperature side channel to the low temperature side channel, wherein the thermal conduction unit has:

a partition member that separates the high temperature side channel and the low temperature side channel from each other; and a thermal resistance reduction unit that reduces the thermal resistance between the partition member and the liquid helium, wherein the thermal resistance reduction unit has a porous body having nano-size pores and fine metal particles having higher thermal conductivity than that of the porous body, and wherein the fine metal particles are fixed to an outer circumference of the porous body as a sintered compact such that the fine metal particles surround the porous body.

2. The heat exchanger according to claim 1, wherein the thermal resistance reduction unit is a sintered compact of the porous body and the fine metal particles.

3. The heat exchanger according to claim 1, wherein the thermal resistance reduction unit has a thickness in a range of 1 to 1000 μm.

4. The heat exchanger according to claim 1, wherein the porous body is a particle in which through holes are formed as the pores.

5. The heat exchanger according to claim 4, wherein the through holes have a diameter that allows helium to exist as a liquid inside the through holes.

6. The heat exchanger according to claim 1, wherein the porous body has an average pore diameter in a range of 2 to 30 nm.

7. The heat exchanger according to claim 1, wherein the porous body are silicate particles whose average particle size is in a range of 50 to 20000 nm.

8. The heat exchanger according to claim 1, wherein the specific area of the porous body is 600 $m^2/g$ or more.

9. The heat exchanger according to claim 1, wherein the fine metal particles are silver particles whose average particle size is in a range of 50 to 100000 nm.

10. A refrigerator comprising:

the heat exchanger according to claim 1;

a mixing chamber inside which a $^3He$ dilute phase and a $^3He$ dense phase are formed and that has an inflow passage for a $^3He$ liquid to flow into the $^3He$ dense phase from the high temperature side channel and an outflow passage for a $^3He$ liquid to flow out to the low temperature side channel from the $^3He$ dilute phase;

a still that has an inflow passage for a $^3He$ liquid flowing in the low temperature side channel to flow in and selectively separates $^3He$ as vapor from a liquid mixture of a $^4He$ liquid and a $^3He$ liquid; and a cooling path that liquefies the $^3He$ separated in the still and returns the liquefied $^3He$ to the high temperature side channel.

* * * * *